US007113156B2

(12) United States Patent
Hashimoto

(10) Patent No.: US 7,113,156 B2
(45) Date of Patent: Sep. 26, 2006

(54) DRIVER CIRCUIT OF DISPLAY DEVICE

(75) Inventor: Yoshiharu Hashimoto, Tokyo (JP)

(73) Assignee: NEC Electronics Corporation, Kanagawa (JP)

( * ) Notice: Subject to any disclaimer, the term of this patent is extended or adjusted under 35 U.S.C. 154(b) by 343 days.

(21) Appl. No.: 10/402,979

(22) Filed: Apr. 1, 2003

(65) Prior Publication Data

US 2003/0189541 A1 Oct. 9, 2003

(30) Foreign Application Priority Data

Apr. 8, 2002 (JP) ..... 2002-104738

(51) Int. Cl.
*G09G 3/30* (2006.01)

(52) U.S. Cl. ..... 345/77; 345/63; 345/89

(58) Field of Classification Search ..... 345/55–107
See application file for complete search history.

(56) References Cited

U.S. PATENT DOCUMENTS

| | | | | |
|---|---|---|---|---|
| 4,967,192 | A | 10/1990 | Hirane et al. | |
| 5,138,310 | A | 8/1992 | Hirane et al. | |
| 5,583,528 | A * | 12/1996 | Ebihara | 345/58 |
| 5,969,709 | A * | 10/1999 | Kim | 345/690 |
| 6,160,534 | A * | 12/2000 | Katakura | 345/98 |
| 6,570,560 | B1 | 5/2003 | Hashimoto | |
| 6,670,938 | B1 * | 12/2003 | Yoshida | 345/98 |

FOREIGN PATENT DOCUMENTS

| | | |
|---|---|---|
| JP | 1167794 | 7/1989 |
| JP | 2160283 | 6/1990 |
| JP | 4-142591 | 5/1992 |
| JP | 4142591 | 5/1992 |
| JP | 4194895 | 7/1992 |
| JP | 6035414 | 2/1994 |
| JP | 63280568 | 11/1998 |
| JP | 11338561 | 12/1999 |
| JP | 2000214656 | 1/2002 |

* cited by examiner

*Primary Examiner*—Richard Hjerpe
*Assistant Examiner*—M. Fatahiyar
(74) *Attorney, Agent, or Firm*—Foley & Lardner LLP

(57) ABSTRACT

It has a gradation voltage generation circuit 1 for generating a plurality of voltage values suited to gamma characteristics of a liquid crystal and so on, a digital image data storage circuit 3 for storing digital image data displayed on a display device, a gradation voltage selection circuit 2 for selecting one value according to digital data stored by the digital image data storage circuit 3 from the plurality of voltage values generated by the gradation voltage generation circuit 1, an amplifier 4 for receiving a voltage selected according to the digital image data and driving a data line of the liquid crystal and so on at a predetermined voltage, a voltage detection circuit 7 for detecting voltage variations of the amplifier 4, a correction data storage circuit 6 for storing a state of the voltage variations of the amplifier 4, and a voltage correction circuit 5 for correcting output voltage variations of the amplifier 4.

7 Claims, 15 Drawing Sheets

Fig. 12A
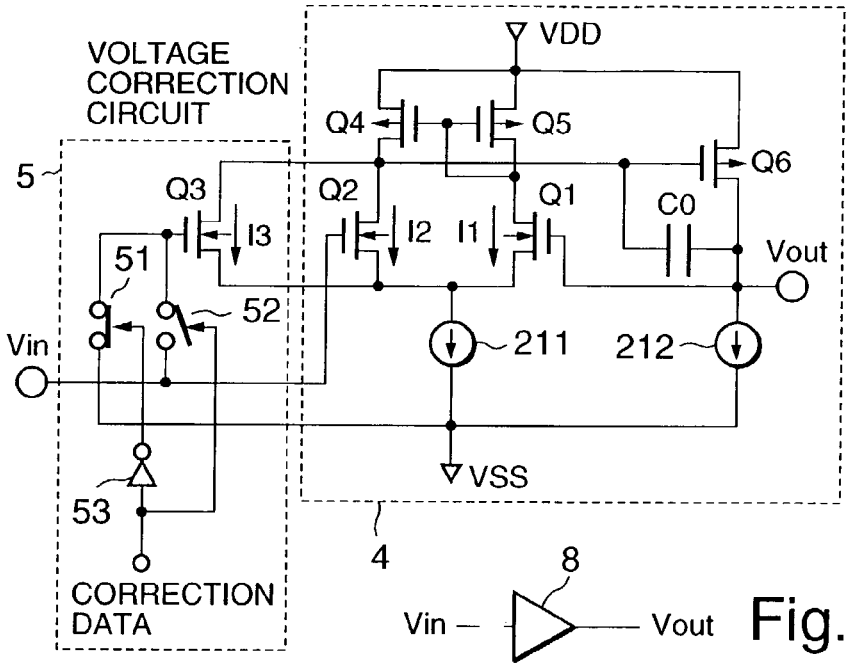
Fig. 12B
Fig. 13
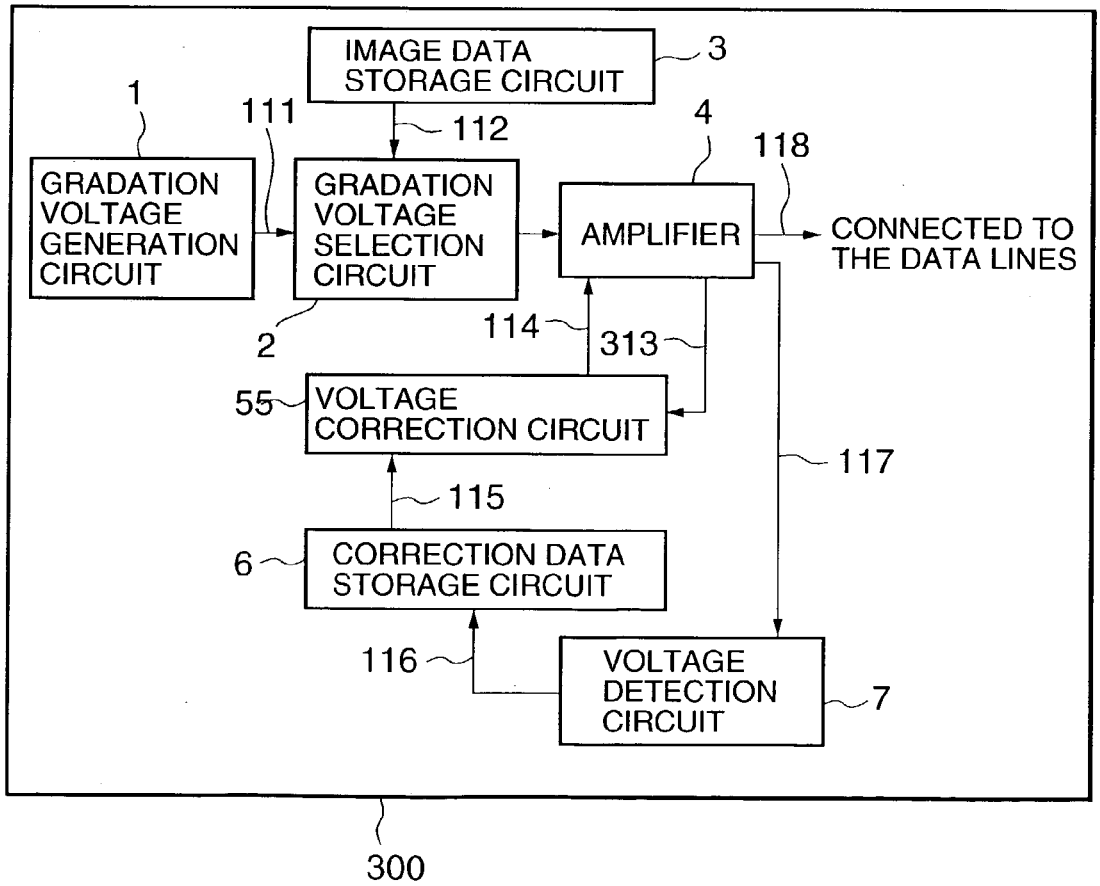

DRIVER CIRCUIT OF DISPLAY DEVICE

BACKGROUND OF THE INVENTION

1. Field of the Invention

The present invention relates to a driver circuit of a display device, and in particular, to the driver circuit of the display device of a self-luminous type such as an organic EL (Electro Luminescence) of which output precision is required.

2. Description of the Prior Art

It is a known fact in recent years that an information electronics device such as a portable telephone is widely used in the world. It is also well known that the information electronics device has a self-luminous type display device such as an organic EL as its display apparatus. A matrix type display device is also well known as one of the representatives of the self-luminous type display devices such as the organic EL.

The display device shown in FIG. 1 or FIG. 2 is also known as such a matrix type display device, for instance.

The matrix type display device in the past 2100 shown in FIG. 1 has a configuration wherein a plurality of data lines (not shown) connected to a data line driver circuit 2103 and a plurality of scanning lines connected to a scanning line side driver circuit 2102 are provided, and a display panel 2101 having a liquid crystal, the organic EL and so on is provided at each intersection thereof.

The matrix type display device in the past 2200 shown in FIG. 2 has a configuration wherein a plurality of data lines (not shown) connected to a data line driver circuit 2203 and a plurality of scanning lines connected to a scanning line side driver circuit 2202 are provided, and a display panel 2201 having the liquid crystal, organic EL and soon is provided at each intersection thereof.

FIG. 3 is an equivalent circuit diagram of a TFT (Thin Film Transistor) liquid crystal cell 1701 using a TFT 1703 as an active element, wherein transmittance is controlled by voltage. FIG. 4 is an equivalent circuit diagram of an organic EL cell 1801 using two TFTs (1803, 1806), wherein luminance is controlled by voltage. FIG. 5 is an equivalent circuit diagram of a simple matrix type organic EL cell 1901, and FIG. 6 is an equivalent circuit diagram of an organic EL cell 2001 using four TFTs (2003, 2006, 2008, 2009), wherein luminance is controlled by currents.

A voltage-control type data driver circuit 1400 of the matrix type display device in the past selects on a gradation voltage selection circuit 2 one voltage value, according to digital image data, of a plurality of voltages generated on a gradation voltage generation circuit 1 (refer to FIG. 7) so as to drive the data lines via an amplifier 4.

When the number of bits of the digital image data increases, the gradation voltage selection circuit 2 increases impedance in order to reduce the area of constituting elements because a chip-occupied space thereof becomes larger in proportion to the number of bits. For that reason, the data lines are driven by having the voltage selected on the gradation voltage selection circuit 2 impedance-converted by an amplifier 4.

In general, a liquid crystal display has a driving voltage range of 3 to 5V, and the digital image data is 4 to 6 bits in the case of the portable telephone and so on.

And a current-control type data driver circuit drives the data lines with a plurality of weighted current sources 31 as shown in FIG. 8.

The data driver circuit of the display device is generally integrated, and has the same number of output terminals as the number of horizontal data lines of the display device. Or in the case where a plurality of data lines are connected to one driver circuit in parallel as shown in FIG. 2, the data driver circuit of the display device has the number of output terminals which is the number of pixels/the number of parallels added thereto, so that the number of the output terminals thereof becomes a few tens to a few thousands or more. As for semiconductor equipment and so on, manufacturing variations cause voltage variations and current variations.

For that reason, Japanese Patent Laid-Open No. 4-142591 proposes a method of, in order to reduce output voltage variations of the data driver circuits of the liquid crystal display device, having the data of which output voltage variations are to be corrected stored by storage circuit in advance and driving the liquid crystal with a signal wherein the data of the storage circuit in synchronization with a clock signal is added to a picture signal.

However, the following problem arises as to the method of adding the digital image data and correction data as with the data driver circuit of the liquid crystal display described in Japanese Patent Laid-Open No. 4-142591.

In the case of the liquid crystal display, a voltage difference capable of recognizing display variations of the liquid crystal is approximately 5 mV or so. In the case where the driving voltage range of the liquid crystal is 3V, it is 3000 mV/5 mV=600 and precision of 9 bits (512-value) or higher is required. To be more specific, 9-bit or more correction data is necessary to correct the voltage variations of the driver circuits.

Even in the case where the digital image data is 6 bits, the circuits from an addition circuit onward are 9 bits or more, and so the circuit scale of the data driver circuit becomes larger.

In addition, a voltage-to-transmittance property of the liquid crystal (FIG. 9) and a voltage-to-luminance property of the organic EL (FIG. 10) are nonlinear and so a correction amount is different according to the voltage. Therefore, as the digital image data cannot be simply added to the correction data, the correction data for each piece of the digital image data is required and thus a correction data storage circuit becomes even larger.

An organic EL display device has a luminance-to-current property which is linear, and so it is driven by the plurality of weighted current sources. In this case, as can be easily presumed from Japanese Patent Laid-Open No. 4-142591, there is a thinkable method of correcting the current value by storing the data for correcting output current variations in advance. However, there are the cases where, as each of the weighted current sources varies independently, a monotone increase property is lost, and the correction data storage circuit becomes enormous because each bit of the digital image data requires the correction data.

Furthermore, the variations at the time of manufacturing are stored in an ROM or the like in order to store the variations in the driver circuits as the correction data in advance, so that the variations cannot be corrected against the change in use conditions (change in temperature and change over time)

SUMMARY OF THE INVENTION

As for a driver circuit of a display device according to the present invention, a matrix type display device having a plurality of scanning lines and a plurality of data lines placed like a matrix thereon has first storage circuit for storing digital image data, first voltage generation circuit for generating a plurality of voltages, first selection circuit for selecting one of the plurality of voltages according to the digital image data, first driving circuit including at least an amplifier for driving the data lines, first detection circuit for detecting output voltage variations of the first driving circuit, second storage circuit for storing a state of the output voltage variations of the first driving circuit, and first correction circuit for correcting an output voltage of the first driving circuit.

In addition, the first correction circuit of the driver circuit of the display device according to the present invention changes a value of a current running in one of a pair of difference input stages constituting the amplifier according to the correction data stored by the second storage circuit so as to change an offset voltage value of the amplifier.

In addition, the first correction circuit of the driver circuit of the display device according to the present invention connects one terminals of a first switch and a second switch to a second transistor connected in parallel with a first transistor of the difference input stages of the amplifier and a gate electrode of the second transistor, connects the other terminal of the first switch to an output terminal of the first selection circuit or the output terminal of the amplifier, connects the other terminal of the second switch to a source electrode of the second transistor, and opens and closes the first switch and the second switch according to the correction data so as to render the second transistor active or inactive and thereby change the value of the current running in one of the pair of difference input stages of the amplifier.

A driving method of the driver circuit of the display device according to the present invention has a third storage step of storing the digital image data inputted to the display device in a third storage circuit, a second driving step of driving data lines with the driving circuit including at least a current source based on the value of the current according to the digital image data, a second detection step of detecting the output current variations of the second driving step, a fourth storage step of storing the state of the output current variations of the second driving step in fourth storage circuit, and a second correction step of correcting an output current of the second driving step.

BRIEF DESCRIPTION OF THE DRAWINGS

This above-mentioned and other objects, features and advantages of this invention will become more apparent by reference to the following detailed description of the invention taken in conjunction with the accompanying drawings, wherein:

FIG. 12A is a detailed view of a voltage correction circuit of the first data driver circuit of the display device according to the first embodiment of the present invention shown in FIG. 11;

FIG. 12B is an equivalent circuit diagram of the voltage correction circuit of the first data driver circuit shown in FIG. 12A;

FIG. 13 is a block diagram showing the configuration of a second data driver circuit of the display device according to the first embodiment of the present invention;

DETAILED DESCRIPTION OF THE PREFERRED EMBODIMENTS

Figure 1:
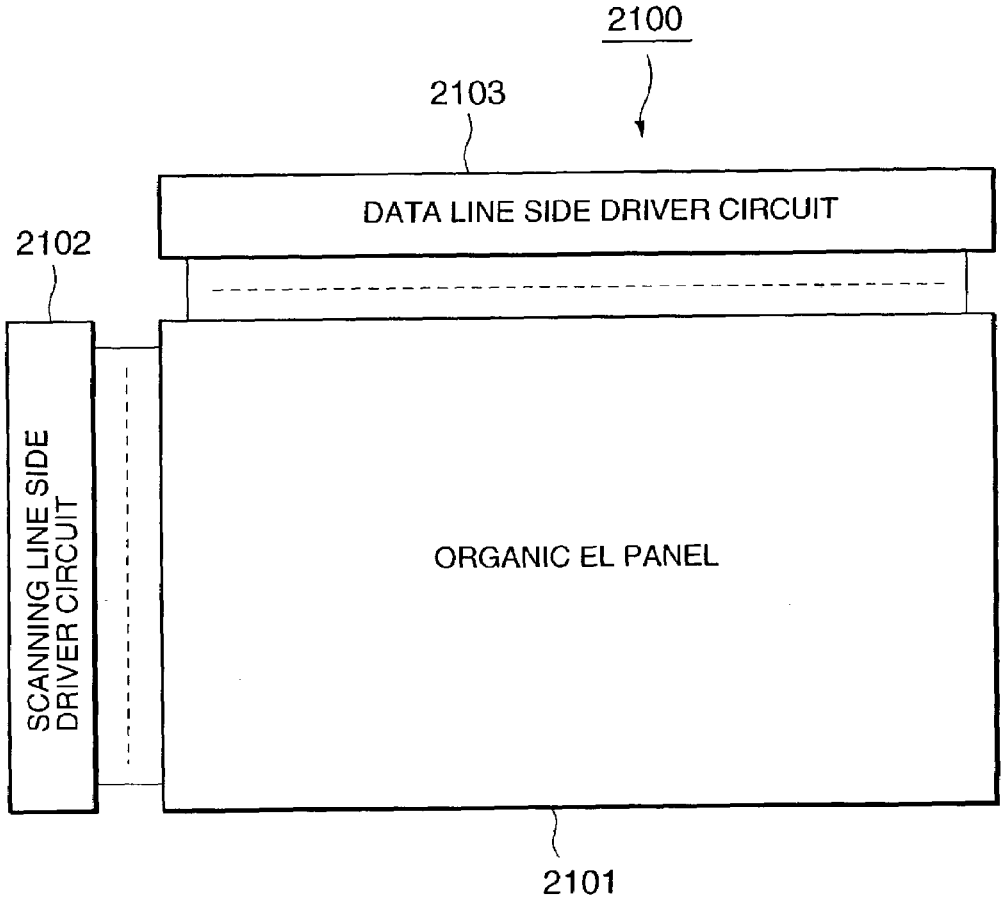
Fig. 1 PRIOR ART
FIG. 1 is a schematic view of a first matrix type display device as a display device in the past.
Figure 2:
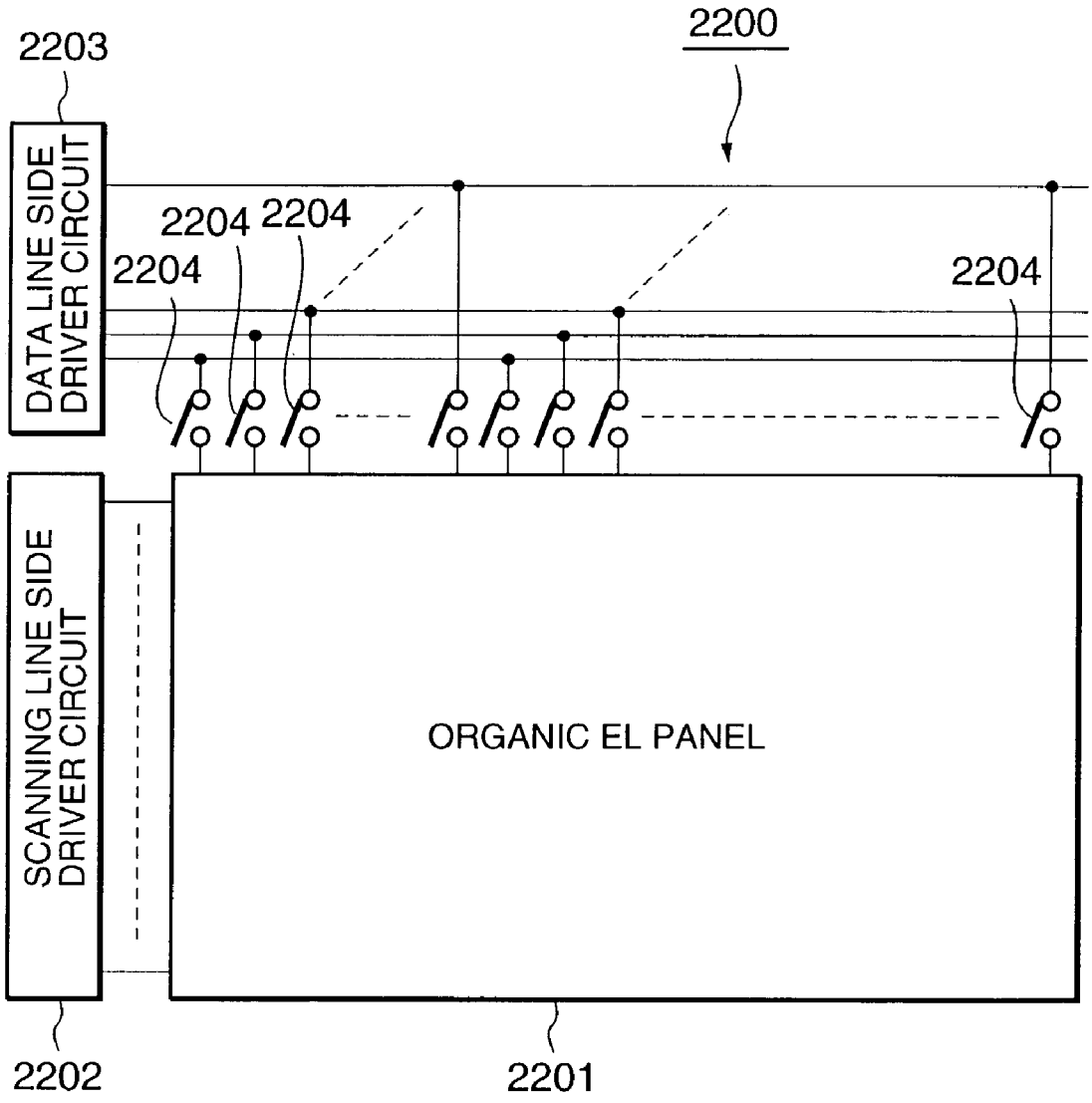
Fig. 2 PRIOR ART
FIG. 2 is a schematic view of a second matrix type display device as the display device in the past.
Figure 3:
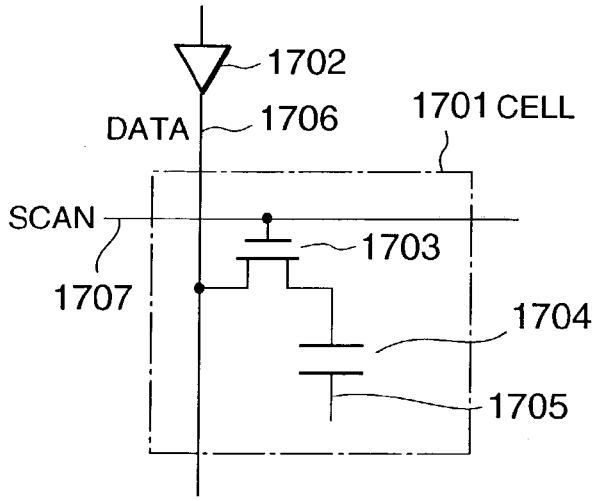
Fig. 3 PRIOR ART
FIG. 3 is an equivalent circuit diagram of a TFT liquid crystal cell.
Figure 4:
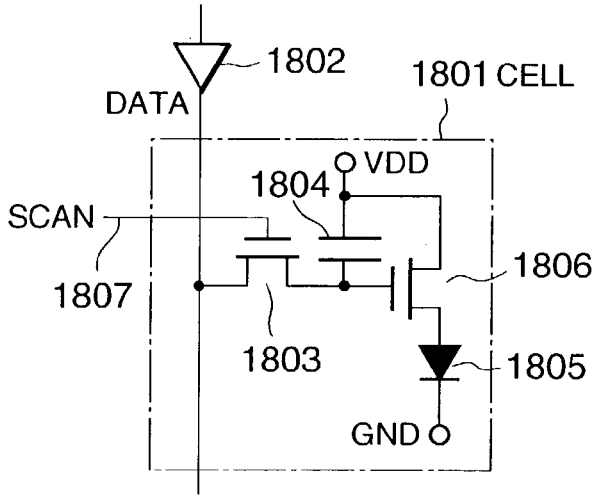
Fig. 4 PRIOR ART
FIG. 4 is a first equivalent circuit diagram of an organic EL cell.
Figure 5:
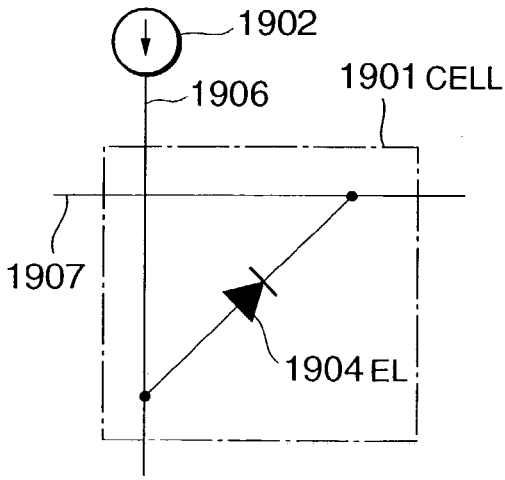
Fig. 5 PRIOR ART
FIG. 5 is a second equivalent circuit diagram of the organic EL cell.
Figure 6:
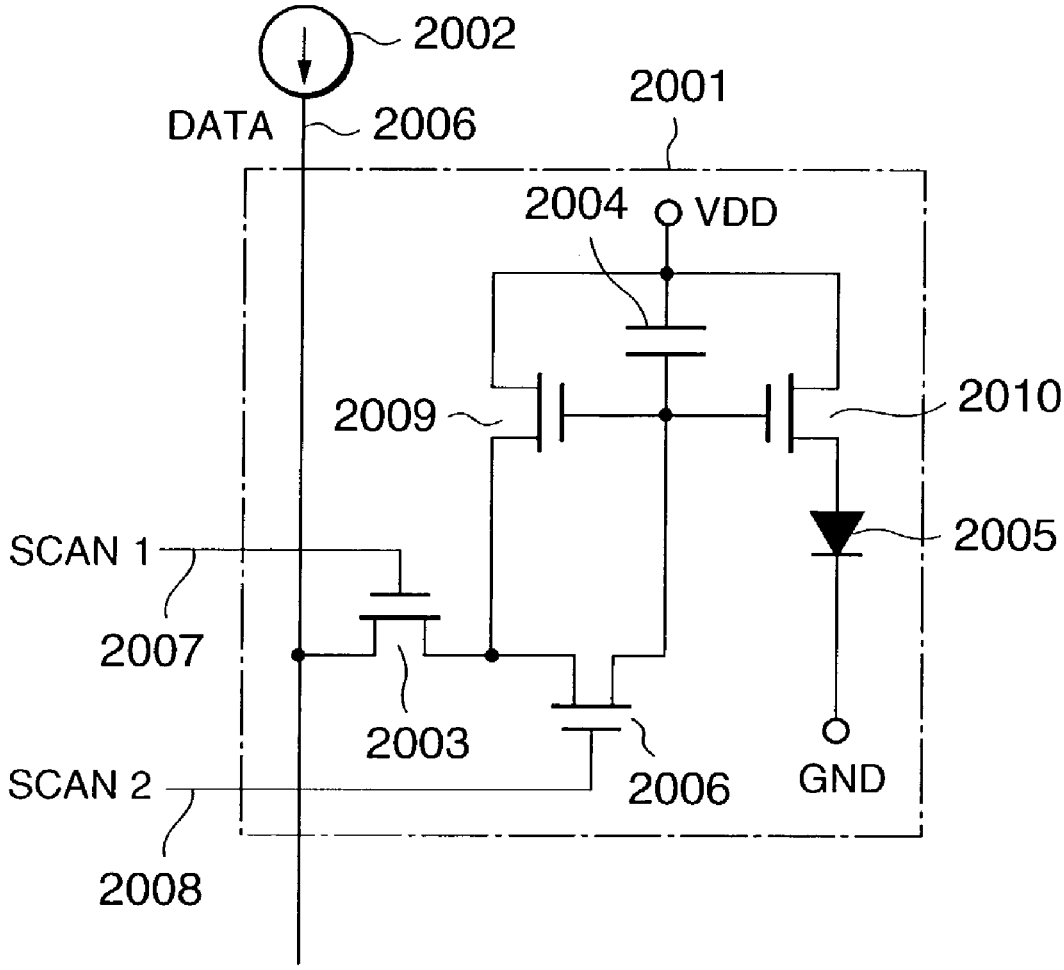
Fig. 6 PRIOR ART
FIG. 6 is a third equivalent circuit diagram of the organic EL cell.
Figure 7:
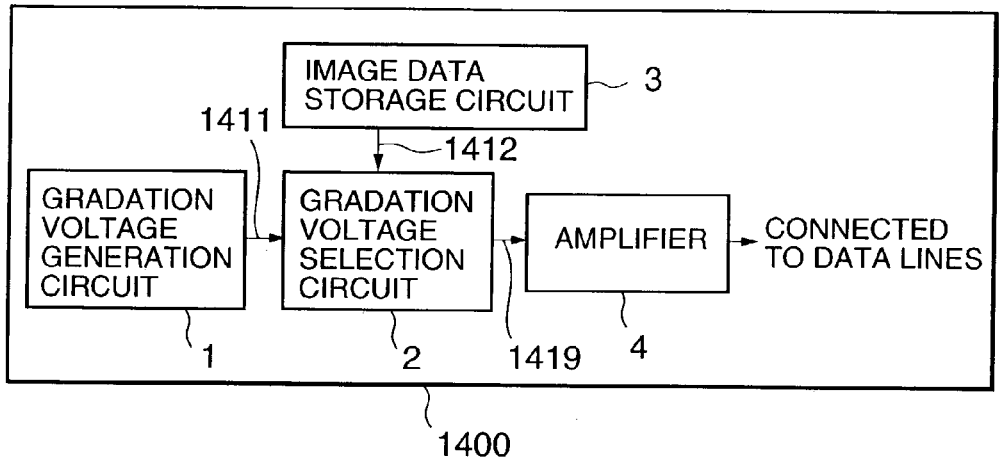
Fig. 7 PRIOR ART
FIG. 7 is a block diagram of a data line driver circuit (voltage-driven type) in the past.
Figure 8:
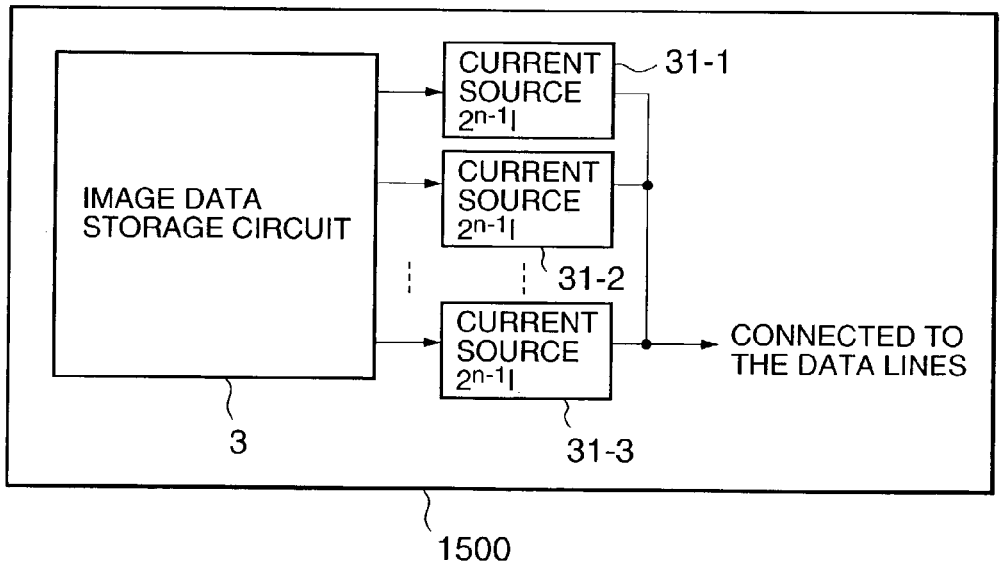
Fig. 8 PRIOR ART
FIG. 8 is a block diagram of a data line driver circuit (current-driven type) in the past.
Figure 9:
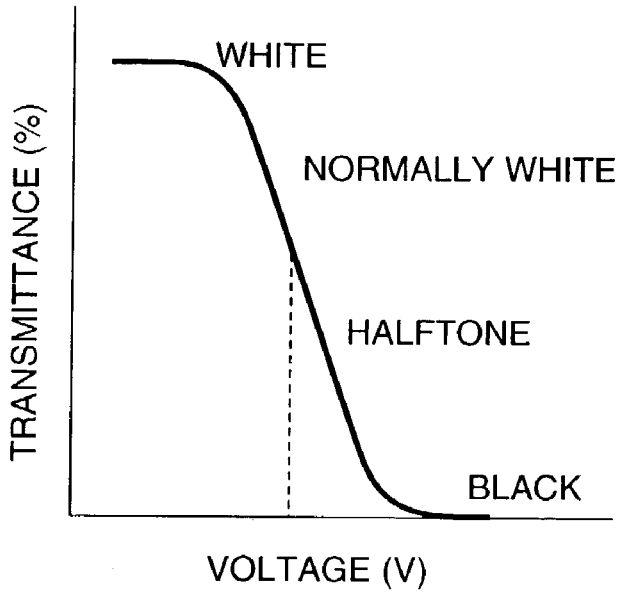
Fig. 9 PRIOR ART
FIG. 9 is a diagram of a transmittance-to-voltage property of a liquid crystal.
Figure 10:
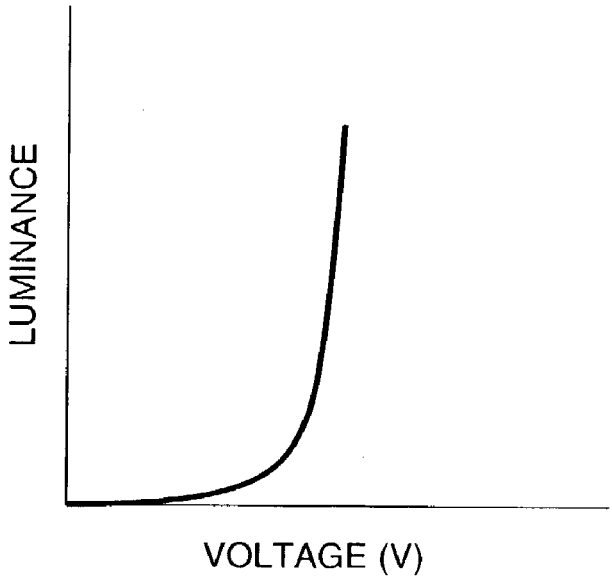
Fig. 10 PRIOR ART
FIG. 10 is a diagram of a luminance-to-voltage property of an organic EL.

Next, an embodiment of a data driver circuit of a display device according to the present invention will be described in detail by referring to the drawings.

(First Embodiment)

Figure 11:
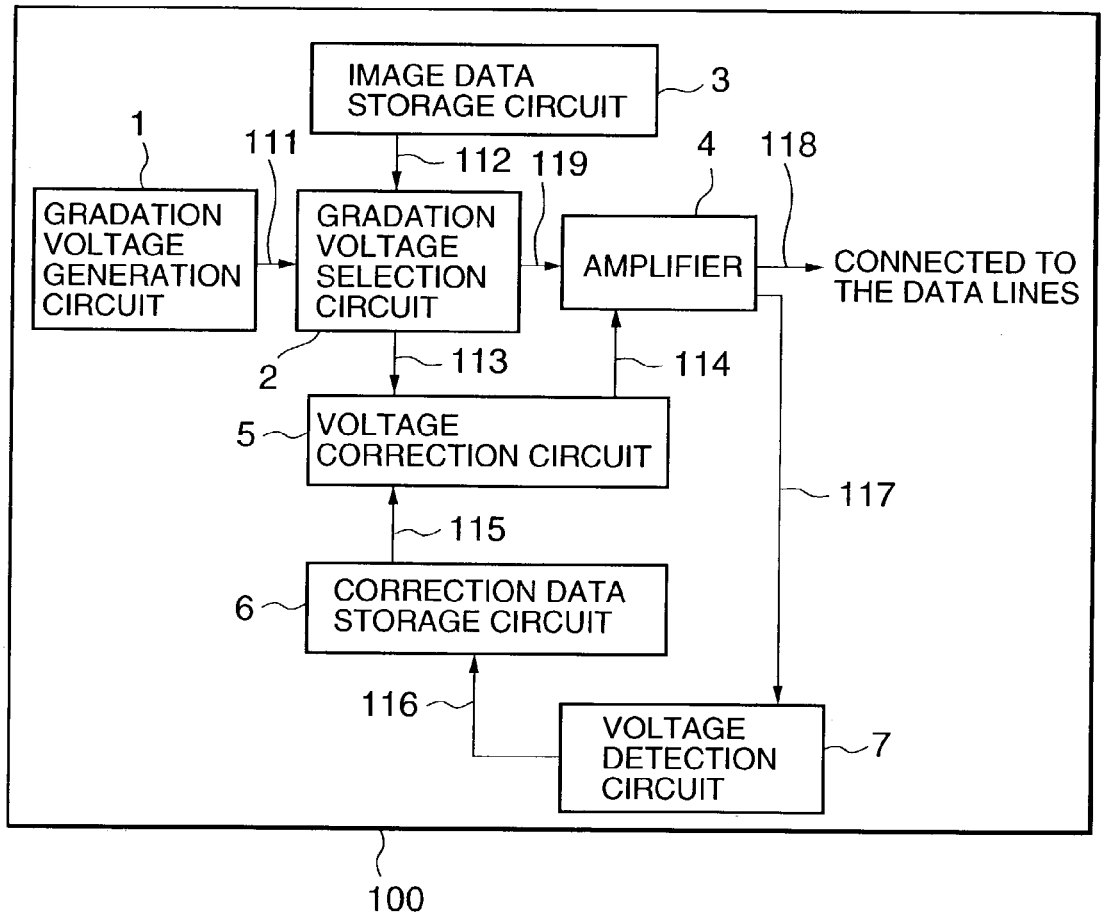
FIG. 11 is a block diagram showing a configuration of a first data driver circuit of the display device according to a first embodiment of the present invention.
Figure 14A:
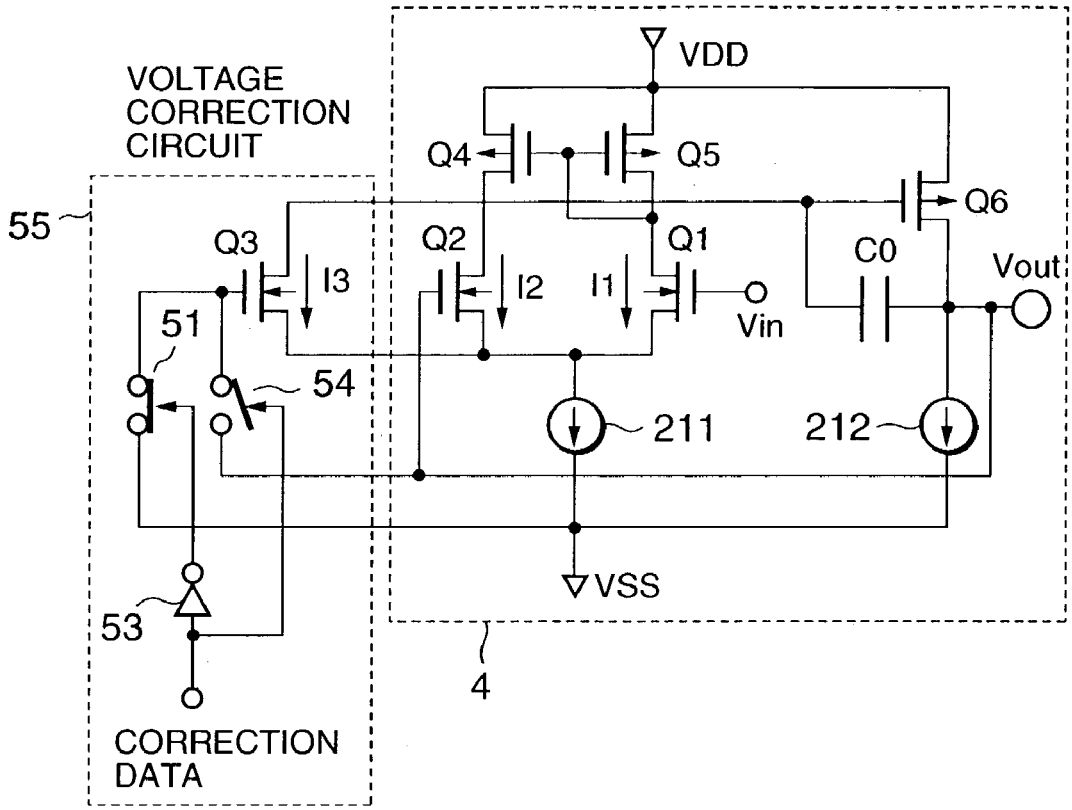
FIG. 14A is a detailed view of the voltage correction circuit of the second data driver circuit of the display device according to the first embodiment of the present invention shown in FIG. 13.
Figure 14B:
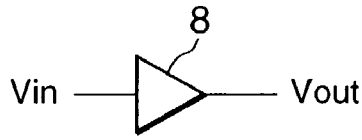
FIG. 14B is an equivalent circuit diagram of the voltage correction circuit of the second data driver circuit shown in FIG. 14A.

FIG. 11 is a block diagram schematically showing a data driver circuit of the display device according to a first embodiment of the present invention.

A data driver circuit 100 of the display device according to the first embodiment of the present invention has a gradation voltage generation circuit 1, comprised of a resistance string circuit (not shown) having a plurality of resistances serially connected, for generating a plurality of voltage values according to gamma characteristics of a liquid crystal and so on, a digital image data storage circuit 3 for storing digital image data displayed on the display device, a gradation voltage selection circuit 2, comprised of a plurality of analog switches (not shown), for selecting one value according to digital data stored by the digital image data storage circuit 3 from the plurality of voltage values generated by the gradation voltage generation circuit 1, an amplifier 4 for receiving the voltage selected according to the digital image data and driving a data line of the liquid crystal and so on at a predetermined voltage, a voltage detection circuit 7 for detecting voltage variations of the amplifier 4, a correction data storage circuit 6 for storing a state of the voltage variations of the amplifier 4, and a voltage correction circuit 5 for correcting output voltage variations of the amplifier 4.

To describe it further in detail, the gradation voltage generation circuit 1 of the data driver circuit 100 of the display device according to the first embodiment of the present invention is a circuit for generating a plurality of voltage values according to gamma characteristics of the liquid crystal and so on, and is comprised of the resistance string circuit (not shown) having the plurality of resistances serially connected. As a color organic EL display device has different driving voltages for red, green and blue, it requires the gradation voltage generation circuits 1 for the respective colors.

The gradation voltage selection circuit 2 of the data driver circuit 100 of the display device according to the first embodiment of the present invention is a circuit for selecting one value according to the digital data stored by the digital image data storage circuit 3 from the plurality of voltage values generated by the gradation voltage generation circuit 1, and is comprised of a plurality of analog switches (not shown). The digital image data storage circuit 3 is comprised of a known latch circuit, an RAM and so on.

The digital image data is synchronized to a clock signal and so on by a shift register circuit (not shown) or the like so as to be sequentially stored by the digital image data storage circuit 3.

The voltage selected according to the digital image data is inputted to the amplifier 4, and the data lines of the liquid crystal and so on are driven at the predetermined voltage.

In the case of 176×240 pixels, a matrix type display device has 528 data lines of 176 lines×3 (RGB) for color display, and requires a plurality of circuits for driving the data lines. Thus, in the case where the circuits are manufactured on a glass substrate such as semiconductor integrated circuits and low-temperature polysilicon, output voltage values of the amplifier 4 vary due to manufacturing variations.

The present invention further has the voltage detection circuit 7 for detecting the voltage variations of the amplifier 4, and has the state of the voltage variations of the amplifier 4 stored by the correction data storage circuit 6 (latch circuit and so on) and has the output voltage variations of the amplifier corrected by the voltage correction circuit 5.

Next, a description will be given to an example of the case where correction data is 1 bit, by referring to FIGS. 12A and 12B or FIGS. 14A and 14B, as to a method of correcting the voltages of the amplifiers of the data driver circuit 100 of the display device according to the first embodiment of the present invention.

The voltage correction circuit 5 has a correction transistor Q3 connected in parallel with one of difference input transistors Q2, and controls a gate voltage of the correction transistor Q3 according to the correction data so as to correct an offset voltage of the amplifier 4. The correction in this case is not rendering the offset voltage of the amplifier as an ideal value, but rendering it closer to that of the amplifier having the highest offset voltage.

In the case where the correction data is 0, a source voltage of the correction transistor Q3 is applied to the gate electrode and the correction transistor becomes inactive with no current running. In the case where the correction data is 1, the voltage selected by the gradation voltage selection circuit is applied to the gate electrode of the correction transistor Q3, and the correction transistor becomes active with a current I3 running. It is thus possible to control the offset voltage of the amplifier by changing the value of the current running in a differential stage of the amplifier. While the example of the case of one correction transistor was described here, it is also feasible to connect a plurality of weighted correction transistors in parallel with the transistor Q2.

Figure 15:
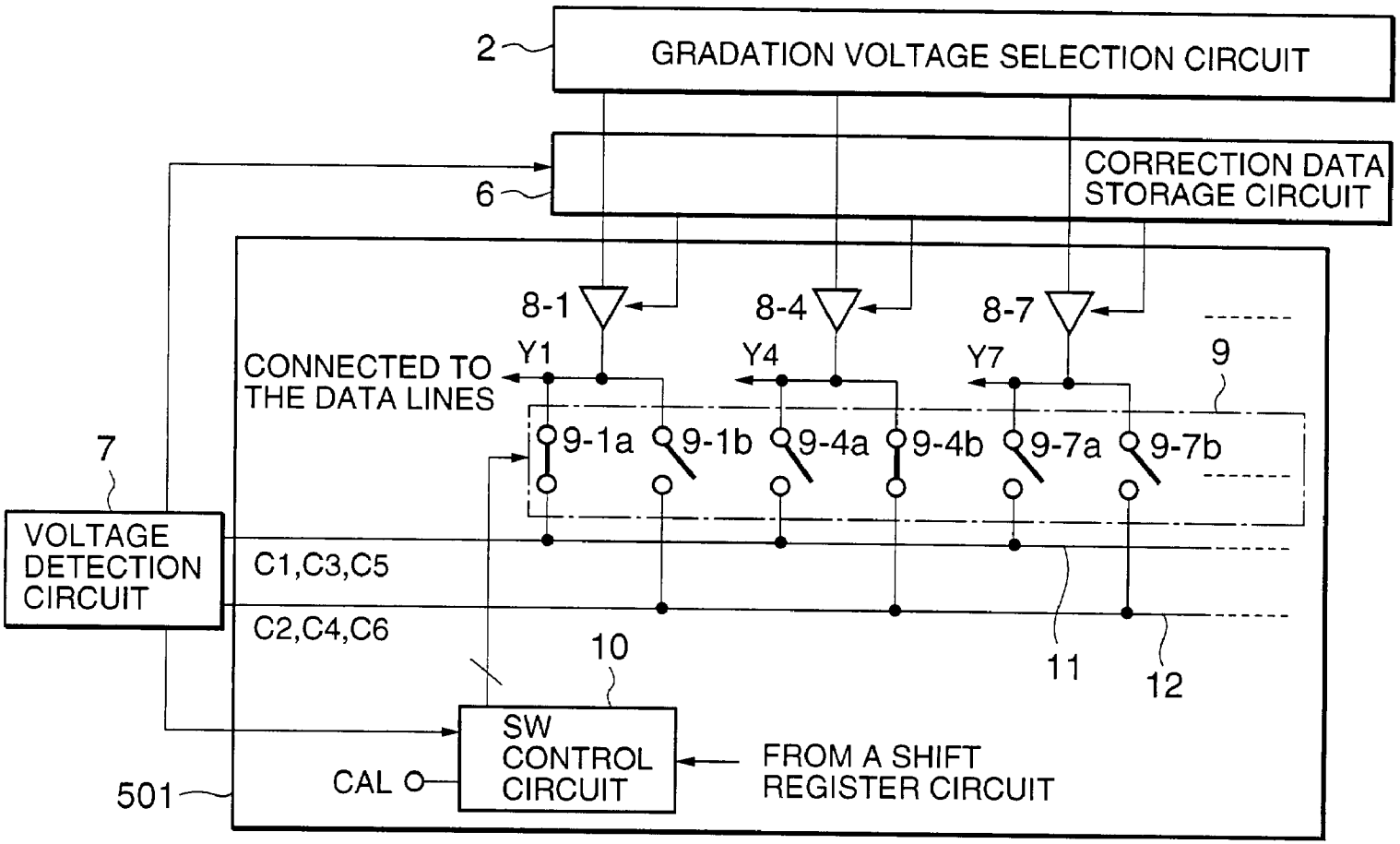
FIG. 15 is a circuit diagram for detecting voltage variations of an amplifier of the data driver circuit of the display device according to the first embodiment of the present invention.
Figure 16:
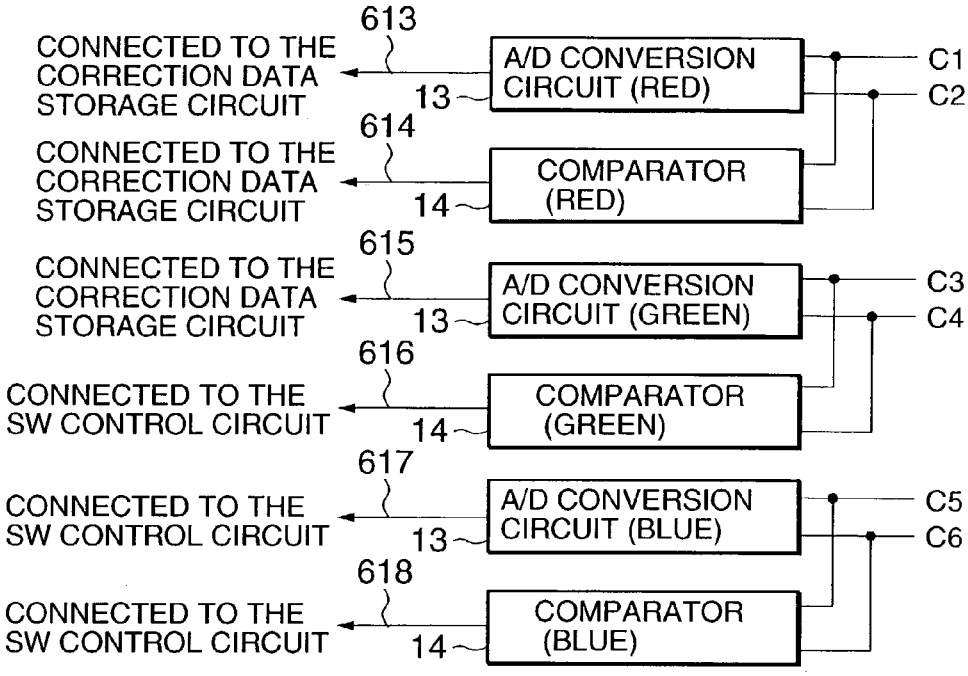
FIG. 16 is a detailed view of a voltage detection circuit of the data driver circuit of the display device according to the first embodiment of the present invention.

Next, FIG. 15 shows the circuit on detecting the voltage variations of the amplifier 4. Output terminals of the amplifiers are connected to the data lines and two switches. One of the switches is connected to a reference line 11 (C1, C3, C5) and the other to a comparison line 12 (C2, C4, C6) As shown in FIG. 16, the reference line 11 and comparison line 12 are connected to an A/D conversion circuit 13 and a comparator 14.

As for detection of relative voltage variations of the amplifiers, the same digital image data (gray display in the case of the liquid crystal, all white display in the case of the organic EL and so on) is transferred to the digital image data storage circuit so that all the amplifiers will output the same voltage.

Next, the comparator 14 makes a comparison between the voltage values of the two amplifiers, and a switch control circuit 10 exerts control so as to connect the amplifier of a higher voltage to the reference line 11. The amplifier of the highest offset voltage is selected by repeating this (the number of amplifiers −1) times. The reason for having the amplifier of the highest offset voltage or the lowest offset voltage selected by the comparator 14 is to simplify the configuration of the voltage correction circuit 5.

The output voltage values of the amplifiers vary in a direction plus or minus to an ideal voltage value (offset voltage is 0). To render the voltage variations of the amplifiers closer to the ideal voltage value, both the values of the currents running in two difference input stages must be changed, so that both the difference input stages require the voltage correction circuits.

Thus, it is possible, by selecting the amplifier of the highest offset voltage before detecting the correction data, to simplify the voltage correction circuits because it is sufficient to adjust only the current running in one of the difference input stages.

Next, the A/D conversion circuit 13 detects differences in the output voltages of the amplifiers in reference to the amplifier of the highest offset voltage value, and stores the detected digital data on the correction data storage circuit 6. The number of bits of the correction data is determined by real values of the voltage variations of the amplifier and the values of voltage differences of which display variations are recognizable by human eyes.

As for a liquid crystal display, the display variations cannot be recognized in the case of the voltage difference of approximately 5 mV or less, and so resolution should be 5 mV or so. In the case where the offset voltage of the amplifier varies by 20 mV at the maximum due to the manufacturing variations and so on, the number of correction bits may be 2 bits (correction amount of the four stages of 0, 5, 10 and 15 mV).

In the case where manufacturing variations are significant, the number of bits of the correction data should be further increased. Thus, it is possible, even if the correction data is 2 bits, to sufficiently correct the voltage variations of the amplifiers. The organic EL requires approximately 3 bits for the correction bits because the voltage differences of which display variations are recognizable by human eyes are smaller than those of the liquid crystal display.

As for the time for detecting the correction data per output, at least the time until the output of the amplifier becomes stable is necessary, which is approximately 10 μs or so as to the one for a small liquid crystal panel.

The time for detecting the correction data of all the outputs is (time for comparison by the comparator+time for A/D conversion)×number of outputs so that it is (10 μs+10 μs)×number of outputs. In the case where there are one comparator and one A/D conversion circuit, it takes 20 μs×528=10.56 ms. However, it can be reduced to 3.52 ms or so by providing the comparators and A/D conversion circuits for the respective colors of red, blue and green.

It is possible to correct the timing of detecting the correction data against the change in use conditions (such as temperature) by automatically inputting a signal to a correction signal (cal signal in FIG. 15) at power-on.

In the case of a self-luminous type such as the organic EL, it is possible to avoid a display error during detection of the correction data by delaying application time of a plate voltage. In the case of a transmissive liquid crystal display, lighting of a back light should be delayed.

In the case of a reflective liquid crystal display, there is a possibility of the display error occurring during the detection of the correction data. However, it will not be displayed if all the scanning lines stop the driving of the scanning lines in a non-selection state, and so it is possible to avoid the display error by stopping the driving of the scanning lines in the non-selection state from the power-on to completion of the detection. The detection of the correction data can be performed not only at power-on but at any time.

(Second Embodiment)

Next, the data driver circuit of the display device according to a second embodiment of the present invention will be described by referring to the drawings.

Figure 17:
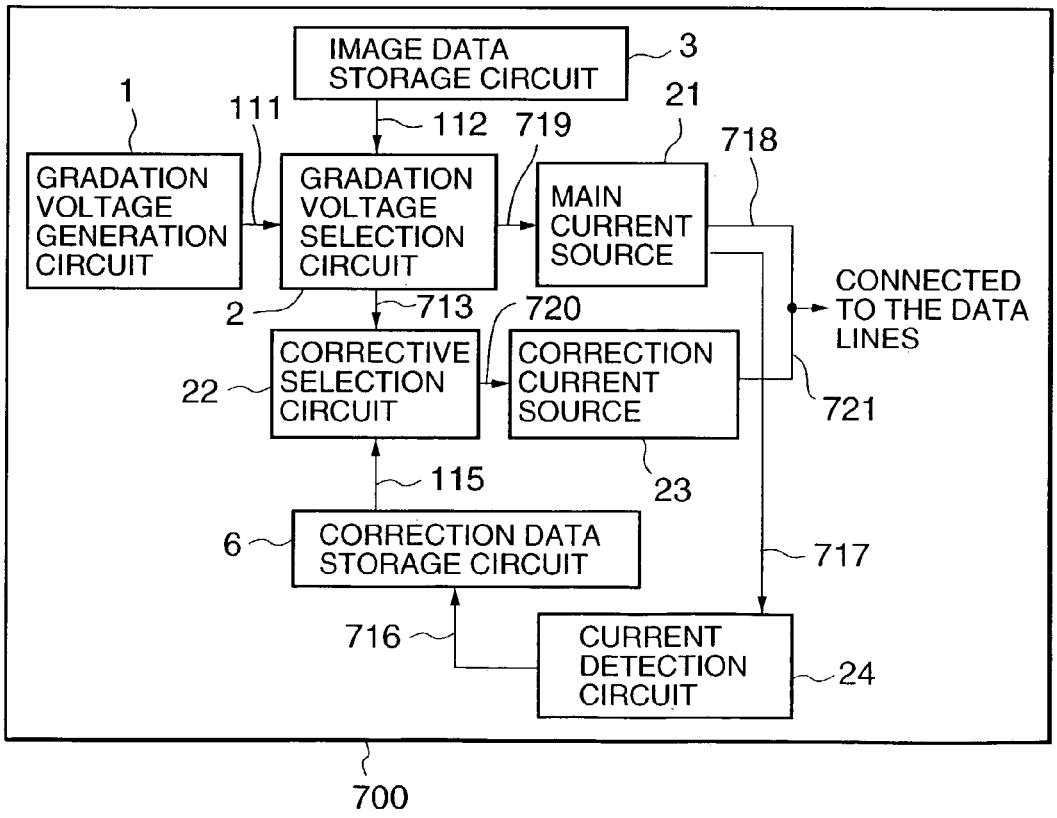
FIG. 17 is a block diagram showing the configuration of the data driver circuit of the display device according to a second embodiment of the present invention.

An example of the case where the correction data is 2 bits will be described by referring to FIG. 17 which is a block diagram of the data driver circuit of the current-driven type display device such as the organic EL of the present invention and FIG. 18 which is a detailed view of FIG. 17.

The data driver circuit of the display device according to the second embodiment of the present invention is different from the prior art in that it has just one current source for driving the data lines (hereafter, it is referred to as a main current source).

Figure 18:
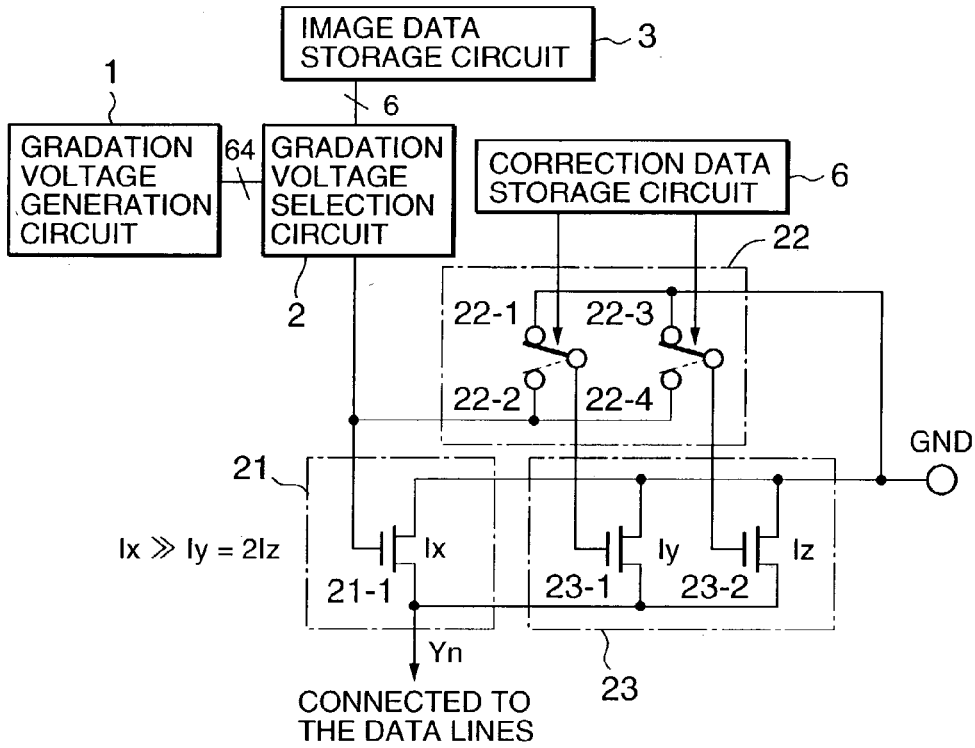
FIG. 18 is a detailed view of the block diagram showing the configuration of the data driver circuit of the display device according to the second embodiment of the present invention.

A main current source 21 of the data driver circuit of the display device according to the second embodiment of the present invention is comprised of one transistor (21-1) as shown in FIG. 18, where a current value Ix of the main current source 21 is controlled by the gate voltage applied to the transistor (21-1). Although it was difficult in the past to secure a monotone increase property because of the driving by a plurality of current sources, it is possible to secure the monotone increase property by having just one current source.

As for the organic EL, the luminance and currents are linear but the luminance and voltages are nonlinear, and so it has a plurality of voltage values generated by the gradation voltage generation circuit 1 to suit to a luminance property of the organic EL, and has the value selected by the gradation voltage selection circuit 2 so as to apply it to the current source.

The present invention has a plurality of correction current sources 23 which are weighted in order to correct current variations of the main current source. While the current variations of the main current source are detected by a current detection circuit 24, the correction current sources 23 are controlled by the correction data so as to correct the value of the current running in the data lines.

In the case where the correction data is 0, a connection is made to a switch terminal (22-1, 22-3) side of a corrective selection circuit 22 in FIG. 18 so that the source voltage is applied to a transistor (23-1) of the correction current sources 23 and each gate of the transistor (23-1) and the current sources become inactive. In the case where the correction data is 1, a connection is made to a switch terminal (22-2, 22-4) side of the corrective selection circuit 22 in FIG. 18 so that the voltage selected by the gradation voltage selection circuit 2 is applied to the transistor (23-1) of the correction current sources 23 and each gate of the transistor (23-1) and the correction current sources 23 become active with the value of the current at a predetermined rate running to the main current source 21.

The value of the current of the correction current sources 23 is set to be several percent of the value of the current of the main current source 21. A drain of the main current source 21 and the drain of the correction current sources 23 are connected to the data lines respectively, which drive the data lines with a corrected value of the current by adding the current of the main current source 21 to the current of the correction current sources 23.

Next, the method of detecting the correction data will be described. Here, as with the first embodiment, the main current source having the largest value of the current is selected by the comparator 14, and the state of current variations of each main current source is stored as the correction data against the main current source having the largest value of the current.

Thus, it only adds the values of the currents of the correction current sources to the values of the currents of the main current sources by correcting the values of the currents of the other main current sources in reference to the main current source having the largest value of the current (no circuit for subtraction is necessary) so as to simplify a circuit configuration of the correction current sources. In the case where an anode and a cathode of the organic EL are reversed, the values of the currents should be subtracted as to the correction current sources in reference to the main current source having the smallest value of the current.

Next, the number of bits of the correction data will be described. In the case of passing 20 nA or so per gray scale in a current-driven type organic EL display device, the resolution should be at least 10 nA or so in order to correct the values of the currents to the extent that the display variations are not recognizable by human eyes.

If the digital image data is 6 bits (64 intensity levels assigned), the currents up to the maximum current of 20 nA×64=1,280 nA are to be passed, where the current variations may be 5 percent or more.

It is possible to correct this in the range of 0 to 7 percent (8 stages) by setting the resolution at 1 percent (12.8 nA) or so of the value of the current of the main current source while the correction data is 3 bits. In the case where the current variations are 7 percent or more, a modification should be made, such as increasing the number of bits of the correction data or setting the resolution at more than 1 percent.

There is a possibility that, as the correction current source is comprised of a plurality of transistors, the monotone increase property thereof is lost. However, it will not be a problem because the amount of the current variations of the correction current source (1,280 nA×7%×5%=4.48 nA) is much smaller than that of the main current source (1,280 nA×5%=64 nA) so that it is the value of the current at which the display variations are not recognizable by human eyes.

(Third Embodiment)

Next, the liquid crystal display according to a third embodiment of the present invention will be described by referring to the drawings.

Figure 19:
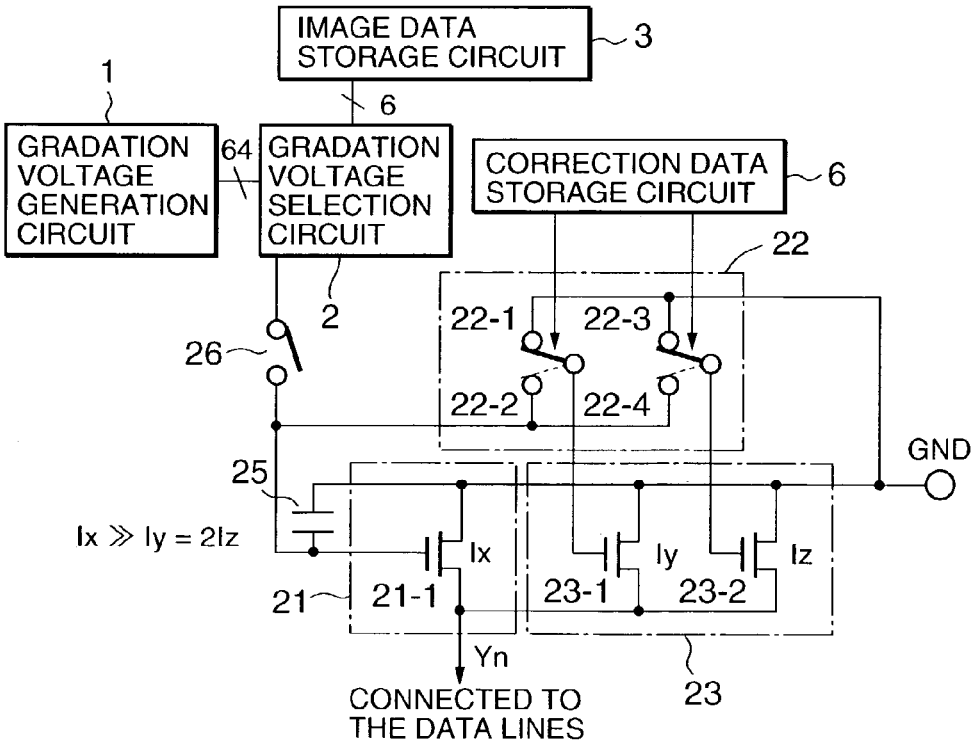
FIG. 19 is a detailed view of the block diagram showing the configuration of the data driver circuit of the display device according to a third embodiment of the present invention.
Figure 20:
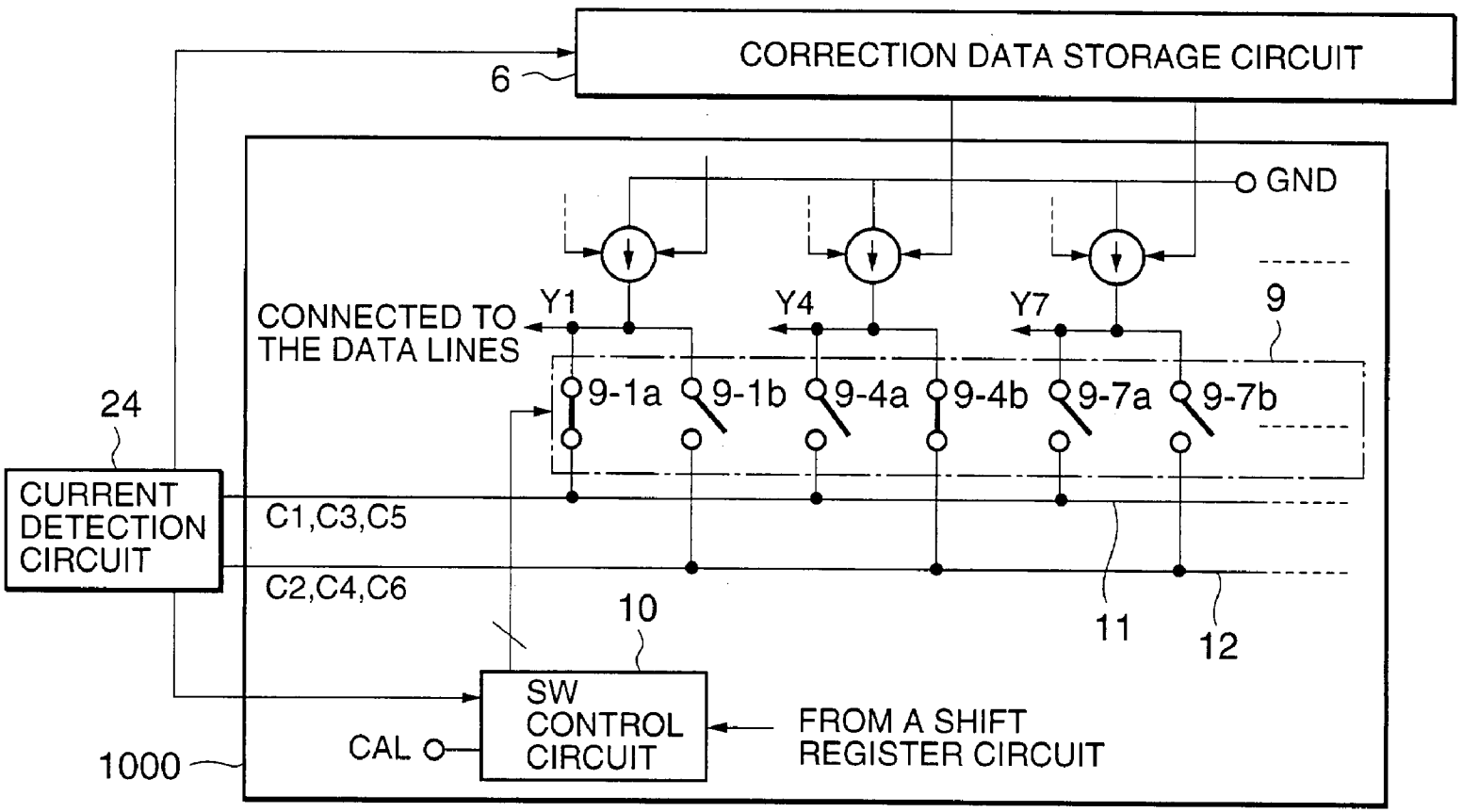
FIG. 20 is a current detection circuit diagram for detecting current variations of a current source of the data driver circuit of the display device according to the embodiment of the present invention.
Figure 21:
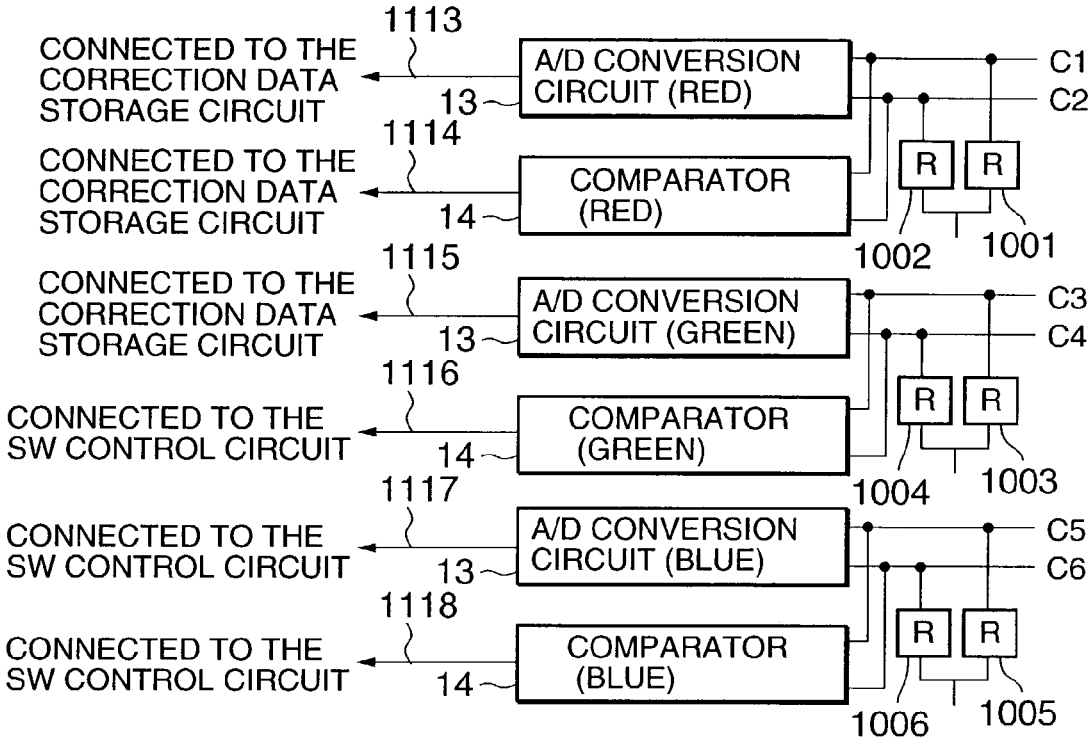
FIG. 21 is a detailed view of the current detection circuit of the current source of the data driver circuit of the display device according to the embodiment of the present invention.
Figure 22:
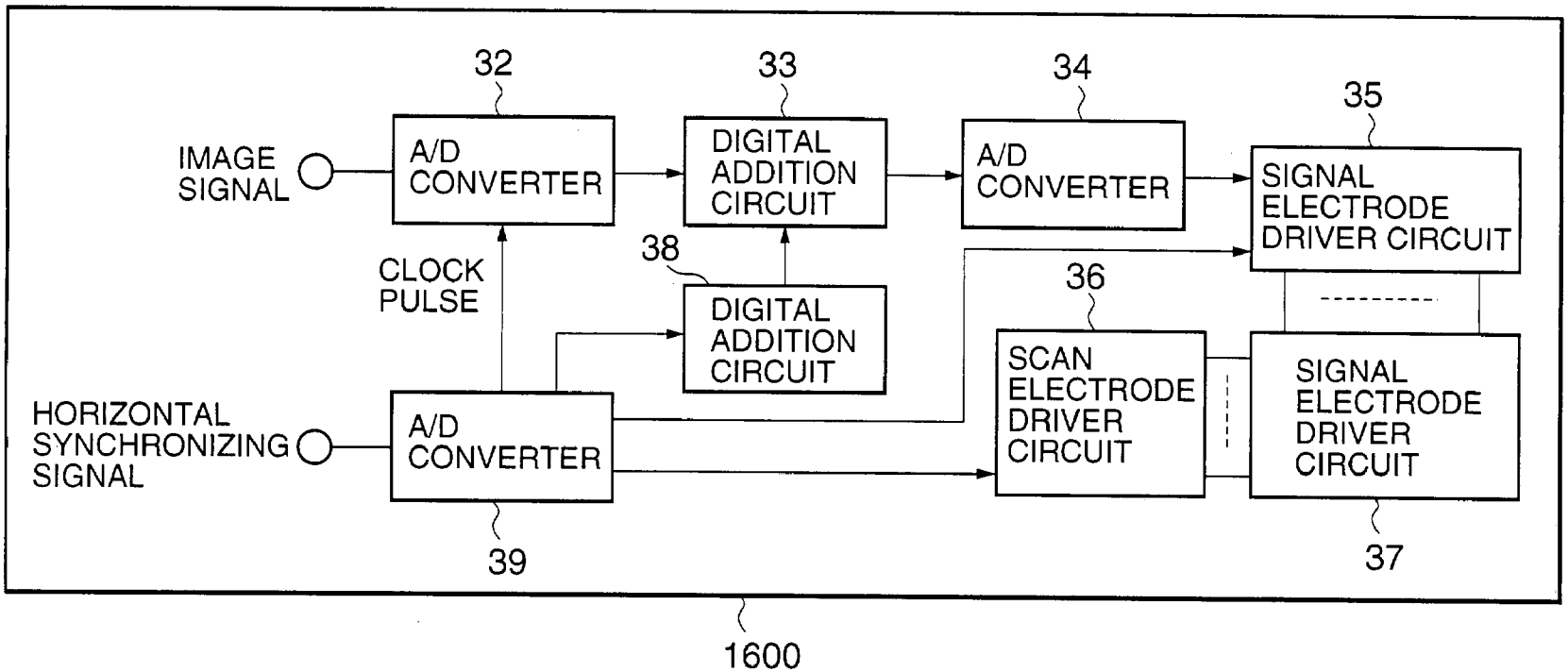
FIG. 22 is a block diagram of correction circuit of a liquid crystal display data line driver circuit.

FIG. 19 is a detailed view of another data driver circuit of the current-driven display device such as the organic EL according to the present invention.

The data driver circuit of the display device according to the third embodiment of the present invention is different from that according to the second embodiment in that it holds the gate voltages of the main current source and the correction current source in a sample hold circuit comprised of a switch 26 and a condenser 25.

While the data driver circuit of the display device according to the second embodiment of the present invention had the voltages selected by the gradation voltage selection circuit applied to the gates of the current sources on each driver circuit, it is possible, by adopting the sample hold circuit, to hold the gradation voltage and reduce the digital image data storage circuits and the gradation voltage selection circuits of each driver circuit.

Compared to the data driver circuit of the display device according to the second embodiment of the present invention, the data driver circuit of the display device according to the third embodiment of the present invention has more significant current variations because the voltage variations of the sample hold circuit itself arise. However, it is also possible, according to the present invention, to simultaneously correct the current variations of the main current source caused by those of the sample hold circuit. In this case, the number of bits of the correction data should be 4 bits or so.

As described above, according to the present invention, it is possible to correct with a small amount of the correction data of 2 to 4 bits or so the voltage variations and current variations of the data driver circuit, which are the causes of vertical line variations of the display device, including not only the manufacturing variations but also the variations due to the changes over time and in temperature so as to allow a good display with no display variations to be obtained.

What is claimed is:

1. A driver circuit of a display device having a plurality of scanning lines and a plurality of data lines placed like a matrix therein, comprising:

a first storage circuit for storing digital image data inputted to the display device;

a first voltage generation circuit for generating a plurality of voltages to be used on said display device when driving said display device;

a first selection circuit for selecting one voltage of said plurality of voltages according to said digital image data;

a first driving circuit including at least an amplifier for driving said data lines;

a first detection circuit for detecting variations in output voltages of said first driving circuit;

a second storage circuit for storing a state of the variations in the output voltages of said first driving circuit; and a first correction circuit for correcting the output voltages of said first driving circuit, wherein:

said first correction circuit connects one terminal of a first switch and a second switch to a second transistor connected in parallel with a first transistor of the difference input stage of said amplifier and a gate electrode of said second transistor, connects the other terminal of said first switch to an output terminal of said first selection circuit or to the output terminal of said amplifier, connects the other terminal of said second switch to a source electrode of said second transistor, opens and closes said first switch and said second switch according to said correction data, and renders said second transistor either active or inactive so as to change the value of the current running in one of the difference input stages of the amplifier.

2. A driver circuit of a display device having a plurality of scanning lines and a plurality of data lines placed like a matrix therein, comprising:

a first storage circuit for storing digital image data inputted to the display device;

a first voltage generation circuit for generating a plurality of voltages to be used on said display device when driving said display device;

a first selection circuit for selecting one voltage of said plurality of voltages according to said digital image data;

a first driving circuit including at least an amplifier for driving said data lines;

a first detection circuit for detecting variations in output voltages of said first driving circuit;

a second storage circuit for storing a state of the variations in the output voltages of said first driving circuit;

a first correction circuit for correcting the output voltages of said first driving circuit;

a first switch;

a second switch; and a first switch control circuit for connecting the first switch and the second switch in parallel with the output terminal of said amplifier and controlling said first and second switches when detecting the variations in said output voltages.

3. A driver circuit of a display device having a plurality of scanning lines and a plurality of data lines placed like a matrix therein, comprising:

a first storage circuit for storing digital image data inputted to the display device;

a first driving circuit including at least a current source for driving said data lines at a value of a current according to said digital image data;

a first detection circuit for detecting variations in output currents of said first driving circuit;

a second storage circuit for storing a state of the variations in the output currents of said first driving circuit;

a first correction circuit for correcting the output currents of said first driving circuit;

a first switch;

a second switch and a first switch control circuit for connecting the first switch and the second switch in parallel with the output terminal of said first current source and controlling said first and second switches when detecting the variations in the output currents.

4. A driver circuit of a display device including a plurality of data lines, comprising:

a first storage circuit for storing digital image data, a plurality of current sources each driving an associated data line with an associated current generated according to the stored image data, a second storage circuit which selects a first current source as a basis among said current sources and stores the current difference between said first current source and the other current sources as a correction data; and a correction circuit which changes an output current of at least the one current source based on said correction data, thereby the data line being driven by a current generated based on said digital image data and said correction data, wherein said first current source flows the largest current among said plurality of current sources.

5. A driver circuit of a display device including a plurality of data lines, comprising:

a first storage circuit for storing digital image data, a plurality of current sources each driving an associated data line with an associated current generated according to the stored image data, a second storage circuit which selects a first current source as a basis among said current sources and stores the current difference between said first current source and the other current sources as a correction data; and a correction circuit which changes an output current of at least the one current source based on said correction data, thereby the data line being driven by a current generated based on said digital image data and said correction data, wherein said first current source flows the smallest current among said plurality of current sources.

6. A driver circuit of a display device including a plurality of data lines, a plurality of scanning lines and a plurality of organic electroluminescence elements each arranged in associated data and bit lines, comprising:

a first storage circuit for storing digital image data;

a voltage generator to produce a plurality of voltages to suit to a luminance property of said organic electroluminescence elements;

a selector which selects a voltage among said plurality of voltages in response to said digital image data, and a driving circuit including at least one first current source which drives the data line;

wherein said data line is driven by a current generated from said first current source which is supplied with the voltage selected by said selector.

7. The driver circuit as claimed in claim 6, said driver circuit further comprising;

a current detection circuit which produces a correction data in response to said current generated from said first current source;

a corrective selection circuit to produce a correction signal based on said correction data; and a correction current source to produce a correction current according to said correction signal and supply said correction current with said data line.

* * * * *